/13/86 OR 4,593,862

United States Patent [19]

Schaefer et al.

[11] Patent Number: 4,593,862

[45] Date of Patent: Jun. 10, 1986

[54] METHOD FOR THE MANUFACTURE OF CHIPS FROM MINERAL, VEGETABLE OR EMBRITTLED MATERIALS AND APPARATUS FOR CARRYING OUT THE METHOD

[75] Inventors: Karl Schaefer, Lechbruck am See; Gottfried Frank-Fahle, Oberursel; Norbert Gasenzer, Kronberg, all of Fed. Rep. of Germany

[73] Assignee: Inter-Wood Maschinen GmbH & Co., Lechbruck am See, Fed. Rep. of Germany

[21] Appl. No.: 673,251

[22] Filed: Nov. 20, 1984

[30] Foreign Application Priority Data

Nov. 26, 1983 [DE] Fed. Rep. of Germany ..... 3342866

[51] Int. Cl.[4] ..... B02L 13/09

[52] U.S. Cl. ..... 241/88; 241/89.2; 241/188 R; 241/189 R; 241/240; 241/241; 241/301

[58] Field of Search ..... 241/74, 84, 86, 88, 241/88.2, 88.3, 89.2, 188 R, 189 R, 189 A, 238, 239, 240, 241, 242, 301

[56] References Cited

U.S. PATENT DOCUMENTS 2,216,612 10/1940 Dunn et al. .
2,690,777 10/1954 Korber et al. .

FOREIGN PATENT DOCUMENTS 1086876 8/1960 Fed. Rep. of Germany .
1653098 6/1971 Fed. Rep. of Germany .
2420189 10/1975 Fed. Rep. of Germany .
2436316 8/1974 Fed. Rep. of Germany ... 241/188 R
2628773 12/1977 Fed. Rep. of Germany .
2639123 12/1977 Fed. Rep. of Germany .
3309517 8/1983 Fed. Rep. of Germany ... 241/188 R

*Primary Examiner*—Howard N. Goldberg
*Assistant Examiner*—Timothy V. Eley
*Attorney, Agent, or Firm*—Flynn, Thiel, Boutell & Tanis

[57] ABSTRACT

Method and apparatus for the manufacture of chips from mineral, vegetable or embrittled materials. In the method the stationary wear plates and striking plates when worn from use are replaced during ball mill operation either continuously or periodically, either with or without pressure plates for the striking bars, and with different feeding speeds. The advance, or feeding, of these plates occurs in a time-dependent and/or energy consumption dependent manner. The apparatus includes a conventional beater mill equipped with a vertical or horizontal rotating beater wheel which has arranged on one or both sides of the stationary crushing path several magazines for storing wear plates and striking bars. The replacement of the wear plates and the striking bars is done by suitably constructed slide members.

3 Claims, 8 Drawing Figures

METHOD FOR THE MANUFACTURE OF CHIPS FROM MINERAL, VEGETABLE OR EMBRITTLED MATERIALS AND APPARATUS FOR CARRYING OUT THE METHOD

FIELD OF THE INVENTION

This invention relates to a method and apparatus for crushing (granulating) of mineral, vegetable or embrittled materials.

BACKGROUND OF THE INVENTION

For the crushing (granulating) of mineral, vegetable or embrittled materials among others, beater mills (hammer mills) are used, the stationary crushing path of which is equipped with wear plates and striking bars, which are received between corresponding pressure plates. Wear plates and striking bars must be replaced frequently, if the desired grain size is supposed to be held within a range of variation which is as narrow as possible. This is also true, even though to a lesser extent, for the pressure plates on both sides of the striking bars.

From the chip-wood industry has become known according to German Pat. No. 33 09 517 a method and an apparatus for carrying out said method, in which the steel strip knives in use are replaced during apparatus operation continuously or periodically with sharp steel strip knives. According to experience, flakes (flat chips) of an always constant quality and form thus are produced from chips. The previously needed machine idle time for the replacement of dulled knives is hereby no longer needed.

However, for the granulating of mineral, vegetable or embrittled materials a method modified according to said German Pat. No. 33 09 517 does not present a satisfactory solution, because not only do the edges of the striking bars dull quickly, but so also do the counterlips of the wear plates which lie close adjacent the inside of the striking bars and, even though to a reduced degree, so also do the wear surfaces of the pressure plates located on both sides of each of the striking bars, which wear surfaces face the beater shoes of the rotor.

The purpose of the invention is to provide a method for the granulating of mineral, vegetable or embrittled materials and an apparatus which serves to carry out said method, with which constant grain sizes can be produced at all times during uninterrupted mill operation.

The invention attains this purpose with a method, in which the wear plates of the stationary crushing path and the striking bars then in use (and, if desired, pressure plates arranged on both sides) are replaced during mill operation continuously or periodically with new (replacement) parts of the same types. Replacement wear plates and striking bars (and their pressure plates if desired) are thus each stored in corresponding magazines on the new part input side of the beater mill, from where they are fed by cylinder-operated slide members to the crushing path. Suitable means such as simple magazines may be used on the worn part discharge side of the beater mill for receiving the worn wear plates and striking bars (and, if desired, the worn pressure plates). Corresponding with their differing wear it is possible to move the wear plates and striking bars (and, if desired, the pressure plates) at different feeding rates through the stationary crushing path. It is hereby possible to load the wear plates and striking bars on the mill's input side more heavily with granulatable material than on the mill's discharge side, in order to compensate for the fact that the mentioned wearable parts wear more the longer they are used in the crushing chamber. Such a different loading with granulatable material can be achieved by a correspondingly sloped position of the beater shoes or, in the case of a beater mill with a horizontal axis, by sloped positioning of said axis.

In a preferred embodiment of the inventive apparatus, wear plates and striking bars are manufactured of thin steel strips incorporating longitudinal grooves which are all identical in form. Each striking bar is held by at least one pressure plate, or if desired by two pressure plates between which the striking bar is tightly clamped. In order to require as little part advancing force as possible during the periodic advance, all pressure plates can be simultaneously released from their striking bars prior to a feeding (part advancing) cycle by movement of a suitable center tension ring, similar to the suggestion in German Pat. No. 24 36 316. However, a center tension ring is not needed if the striking bars are each clamped fixedly between two pressure plates and are moved therewith continuously or periodically through the stationary crushing path. The running surfaces of the pressure plates, which running surfaces face the beater shoes, can be designed in a conventional manner to be regrindable and readjustable.

In the inventive method for continuous granulating of mineral, vegetable or embrittled materials, for the first time the factors "crushed particles quality", "wear part use" and "energy consumption" are presented in a preselectable relationship and thus optimized, whereby furthermore the previously needed idle mill times ("down time") for the replacement of the worn parts, no longer exist.

BRIEF DESCRIPTION OF THE DRAWINGS

The invention will be discussed in greater detail in connection with the drawings, in which.

DETAILED DESCRIPTION

Figure 1:
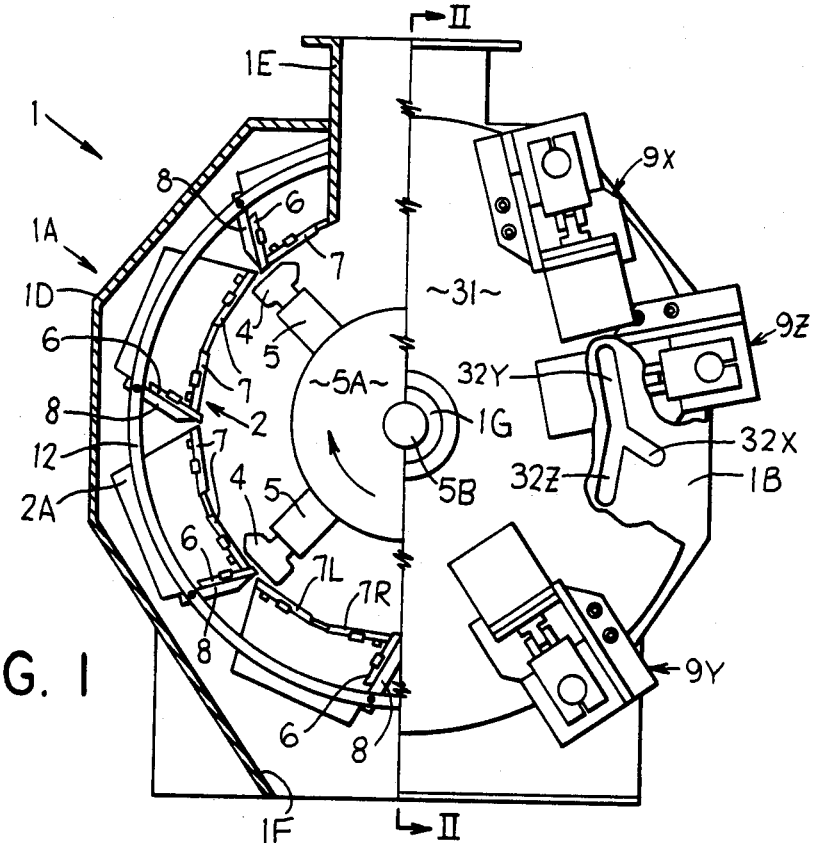
FIG. 1 is a partially broken end view of a beater mill embodying the invention.
Figure 2:
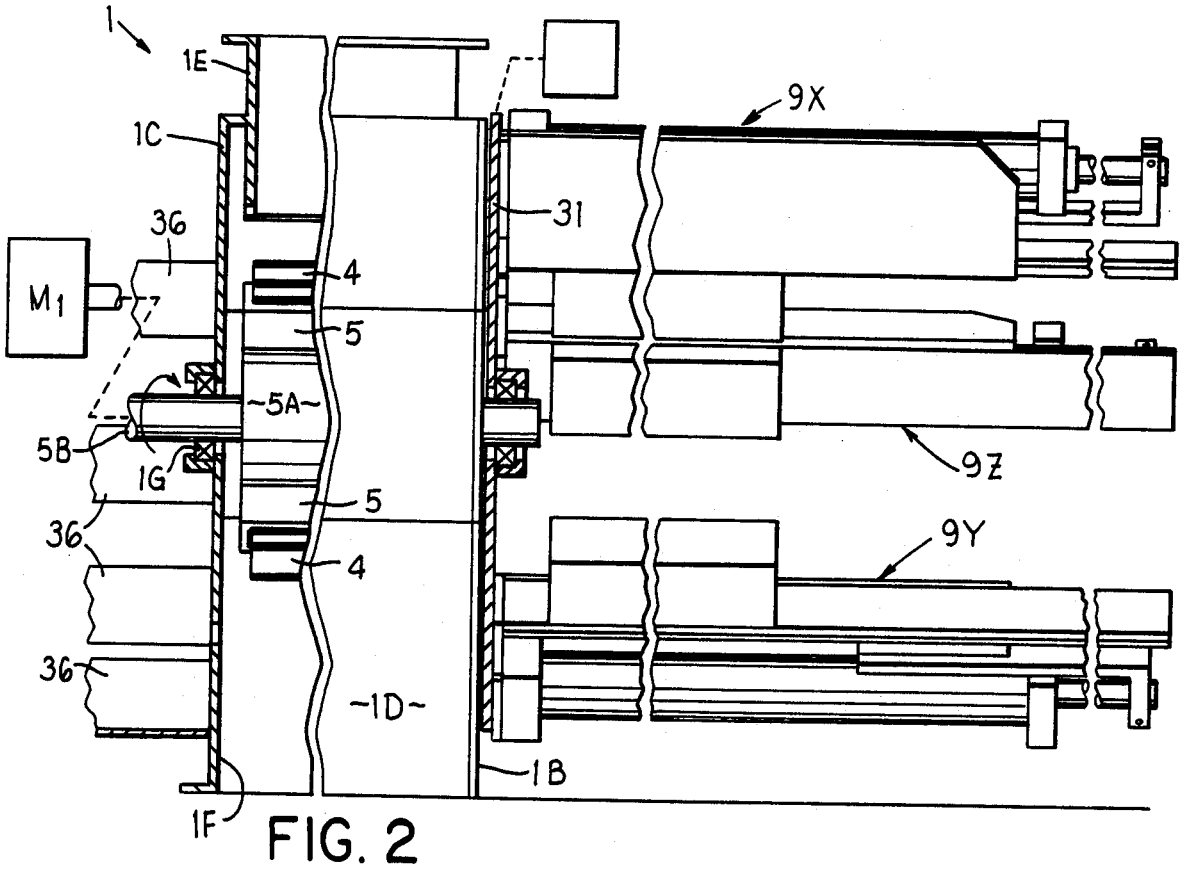
FIG. 2 is a fragmentary partially broken left side view of the FIG. 1 mill, the left and right end portions of FIG. 2 being broken away in central cross section substantially as taken along the line II—II of FIG. 1.
Figure 3:
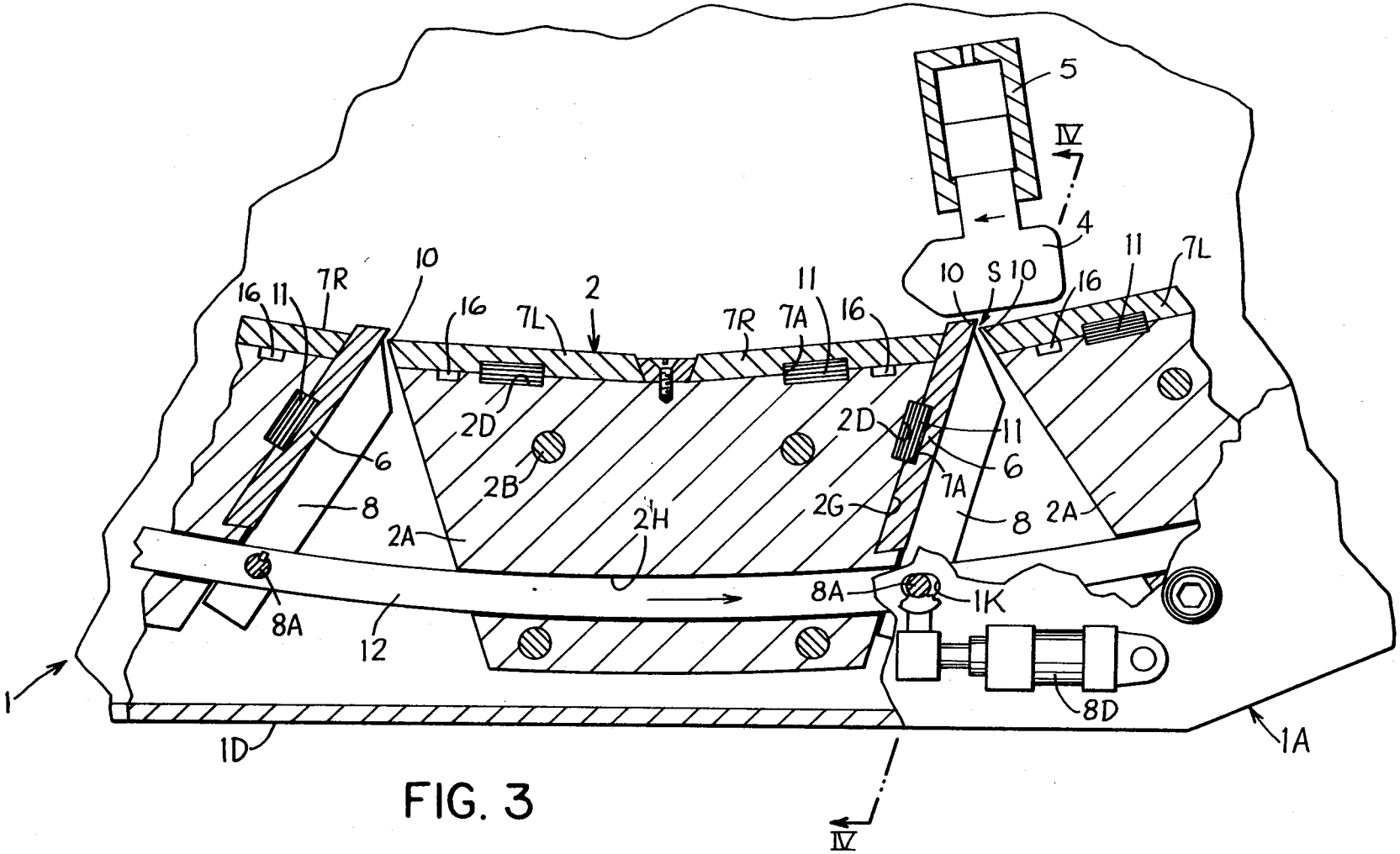
FIG. 3 is an enlarged fragment of FIG. 1, defining a cross-sectional view of a circumferential segment of the crushing ring of a beater mill, taken in a plane perpendicular to the axis of rotation of the rotor of the beater mill, and showing an embodiment in which the striking bars are movable by themselves through the stationary crushing path.
Figure 4:
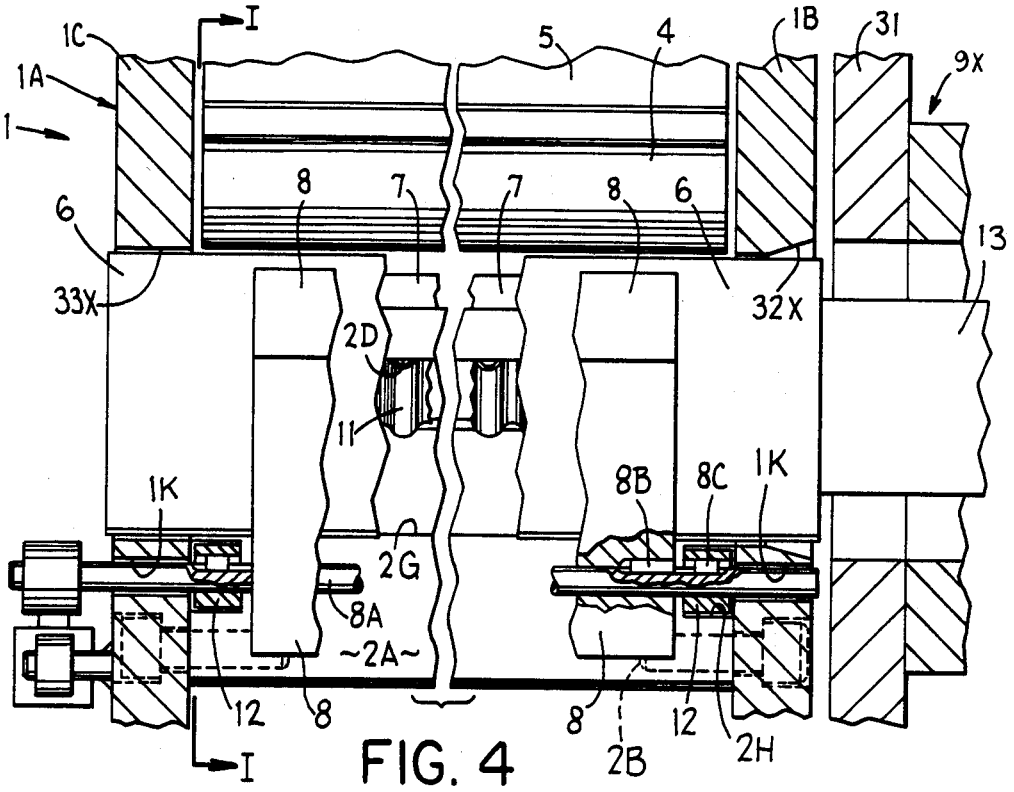
FIG. 4 is a fragmentary partially broken cross-sectional view taken approximately on the line IV—IV of FIG. 3.
Figure 7:
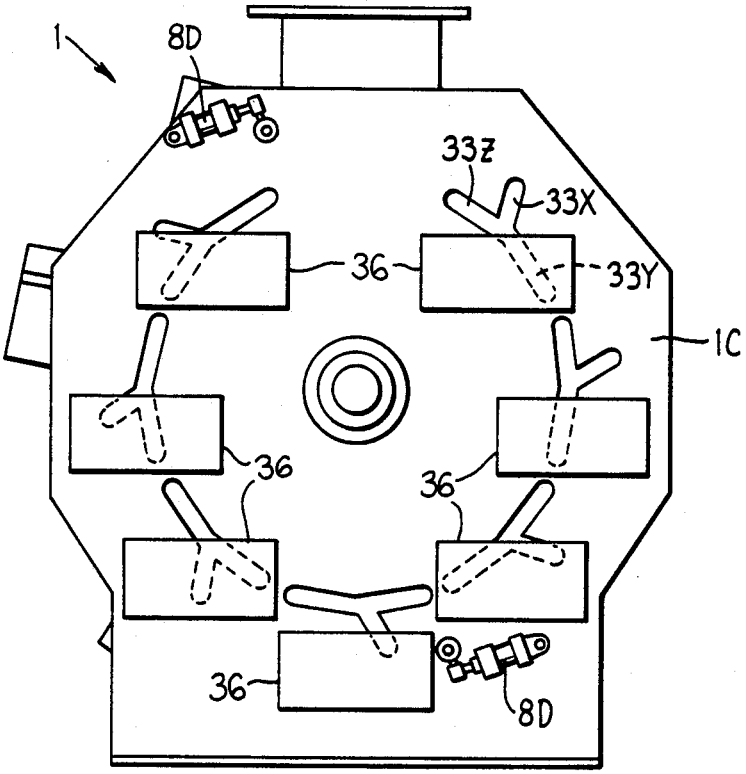
FIG. 7 is a fragmentary end elevational view of the beater mill taken from the end thereof opposite the end shown in FIG. 1 (i.e., taken from the left in FIG. 2).

The beater mill 1 comprises a housing 1A (FIGS. 1 and 7) having upstanding input and output end walls 1B and 1C connected by an axially extending generally cylindrical (here multi-sided) peripheral wall 1D having an open upper end hopper 1E for receiving material to be granulated and a bottom outlet opening 1F through which granulated material exits. The beater mill 1 further comprises a cylindrical, stationary crushing path 2 and a rotor 5A carrying beater shoe arms 5 in turn carrying beater shoes 4. The crushing path 2 is formed by a plurality of circumferentially closely spaced, substantially trapezoidal cross section crossbars 2A (FIGS. 1, 3 and 4) which extend axially between the housing end walls 1B and 1C and are fixed thereto by any convenient means such as screws 2B. The crossbars are distributed coaxially around the rotor 5A which in turn is rotatable with the central shaft 5B as supported by bearings 1G in the housing end walls 1B and 1C for rotation with respect thereto, the rotor 5A being rotatably driveable by a conventional motor M1 (FIG. 2). The inside surface of the stationary crushing path 2 is formed by closely and evenly circumferentially spaced wear plates 7, in longitudinal grooves 7A in which slide exchangeable springs 11. More particularly, the crossbars 2A each have an interior surface 2C for supporting thereon a pair of the wear plates 7 and provided with a pair of axially extending grooves 2D which oppose the axial grooves 7A in the wear plates 7 and are held in circumferential registry therewith by the exchangeable springs 11, each of which extends the full depth of an opposed pair of grooves 7A and 2D for guiding the wear plates 7 axially along the corresponding crossbar 2A. A keystone-shaped guide rail 2E is centrally fixed as by screws 2F on the inner surface of each crossbar and extends axially thereon, the circumferential side edges of the guide rail 2E being undercut as seen in FIG. 3. Permanent magnets 16, each being formed by either a continuous axial strip magnet or a plurality of axially spaced magnet segments, are fixedly embedded in the interior surface 2C of each crossbar 2A near the outer circumferential edges thereof. The axial edges of the wear plates 7 are sloped as shown, so that the circumferentially outer edges thereof are coplanar with the sloped circumferential sides of the crossbar 2A and so that the circumferentially inner edges of the wear plates complement the undercut slope of the circumferential edges of the guide rail 2E. The springs 11 cooperate with the grooves 7A and 2D to fix the circumferential location of the wear plates 7 on their corresponding crossbar 2A and to hold the circumferentially inner edges of the wear plates 7 trapped under the undercut circumferential edges of the guide rail 2E, so as to maintain the circumferential inner edges of the wear plates 7 snug against the interior surface 2C of the crossbar 2A. The exchangeable springs in the present embodiment are, as generally indicated in FIG. 4, axially elongate multiple wave leaf springs (having an axial series of circumferentially extending troughs and ridges) and fitted sufficiently snugly into the grooves 2D in the crossbar 2A as to be removably fixed thereon while having sufficient clearance in the grooves 7A of the wear plates 7 as to allow the wear plates 7 to slide axially with respect to the springs 11 and crossbars 2A. The permanent magnets 16 insure a flutter-free fit of the wear plates 7 in the area of their counter-lips 10. In this way, the wear plates 7 can be slid axially along the interior surface of the crossbar 2A in their cross-sectional position shown in FIG. 3 and when centered in the housing 1A, to cover the interior surface 2C of the crossbar 2A, the wear plates 7 will, in use of the apparatus, be held firmly and immovably in place on the interior surface 2C of the crossbar 2A.

Striking bars 6 are in form completely identical to the wear plates 7. Such a striking bar 6 is located at the upstream (rightward in FIG. 3) edge of the corresponding crossbar 2A in a recess 2G of circumferential depth slightly less than the thickness of the striking bar 6. Like the wear plates 7, the striking bar 6 has parallel sloped end edges and a spring receiving axial groove 7A opposing a corresponding axial groove 2D in the recess 2G of the crossbar 2A. Accordingly, the striking bar 6 is axially insertable into its working position on the upstream edge of the crossbar 2A with its circumferential and radial position controlled by contact with the corresponding spring 11 and the walls of the recess 2G. A pressure plate 8 is actuable (as hereafter described) to clamp the striking bar 6 in the recess 2G of the crossbar 2A in its position shown in FIG. 3 and, alternately, is releasable to permit axial removal of a worn striking plate 6 in replacement thereof with a new striking plate 6, as hereafter more fully described. When clamped in place in its recess 2G, as shown in FIG. 3, the striking bar 6 has its upper edge protruding up somewhat beyond the adjacent wear plate 7 against which its back bears. The striking bar 6 is separated from the counter-lip 10 of the wear plate 7 on the adjacent crossbar 2A (to the right thereof in FIG. 3) by a circumferentially narrow slot S extending axially the width of the housing 1A. It will be seen that as the beater shoe, or hammer, 4 rotates clockwise in FIG. 3, it will force material to be granulated against the sharp interior lip 10 of the striking bar 6 and tend to granulate it and drive the resulting granules radially outwardly through the slot S into the portion of the housing radially outside the crushing path 2, to fall out the bottom outward opening 1F of the housing as seen in FIG. 1.

Clamping and unclamping of the striking bars 6 by the pressure plates 8 may be accomplished as follows. A coaxial tension ring 12 is circumferentially movable as indicated by the arrow thereon in FIG. 3 to relieve the clamping force, normally applied to the striking bars 6 by pressure plates 8, during periodic axial advancement of replacement striking bars 6. In the embodiment shown in FIGS. 3 and 4, a pair of coaxial tension rings 12 are provided within the housing 1A adjacent the interior surfaces of the housing side walls 1B and 1C and are circumferentially shiftable in circumferential grooves 2H in the axial end faces of the crossbars 2A radially outward of the recesses 2G and striking bars 6. Each of the pressure plates 8 has a shaft 8A extending axially therebeyond through the tension rings 12 and thence out through circumferential slots 1K in the side walls 1B and 1C of the housing 1A. The slots 1K are of low clearance radially to accurately locate the tension rings 12 and pressure plates 8 radially of the housing and crossbars 2A. However, the slots 1K are circumferentially widened sufficient to allow enough circumferential movement of the tension rings and pressure plates 8 as to allow the pressure plates 8 to be circumferentially clamp and unclamp the striking bars 6 with respect to their crossbars 2A. Pivoting of the pressure plates 8 with respect to the tension rings 12 is prevented by keying of both against rotation on the shafts 8A, by means of keys 8B and 8C (FIG. 4). Thus, the tension rings 12 and the plurality of pressure plates 8 move circumferentially as a unit to clamp or unclamp the striking bars 6. Such circumferential clamping and unclamping movement can be accomplished, for example by actuation of pressure fluid cylinders 8D operatively interposed between the housing 1C and preferably diametrally opposed ones of the shafts 8A. The tension rings 12 and pressure plates 8 are preferably further constrained to move only circumferentially by providing the rings 12 with a radially close sliding fit within the circumferential grooves 2H. The circumferential clearance in the slot 1K is less than the depth of the groove 2D in crossbar 2A so that, even when it is released, the pressure plate 8 is close enough spaced to the opposed crossbar 2A as to keep a striking bar 6 being axially fed into, or out of, the housing, snugly in register with the recess 2G and spring 11. Accordingly, wear plates 7 and striking bars 6 when being axially fed into or out of the upper portion of the housing 1A are prevented from falling down (due to gravity) away from their proper location in the crushing path.

Figures 5, 6:
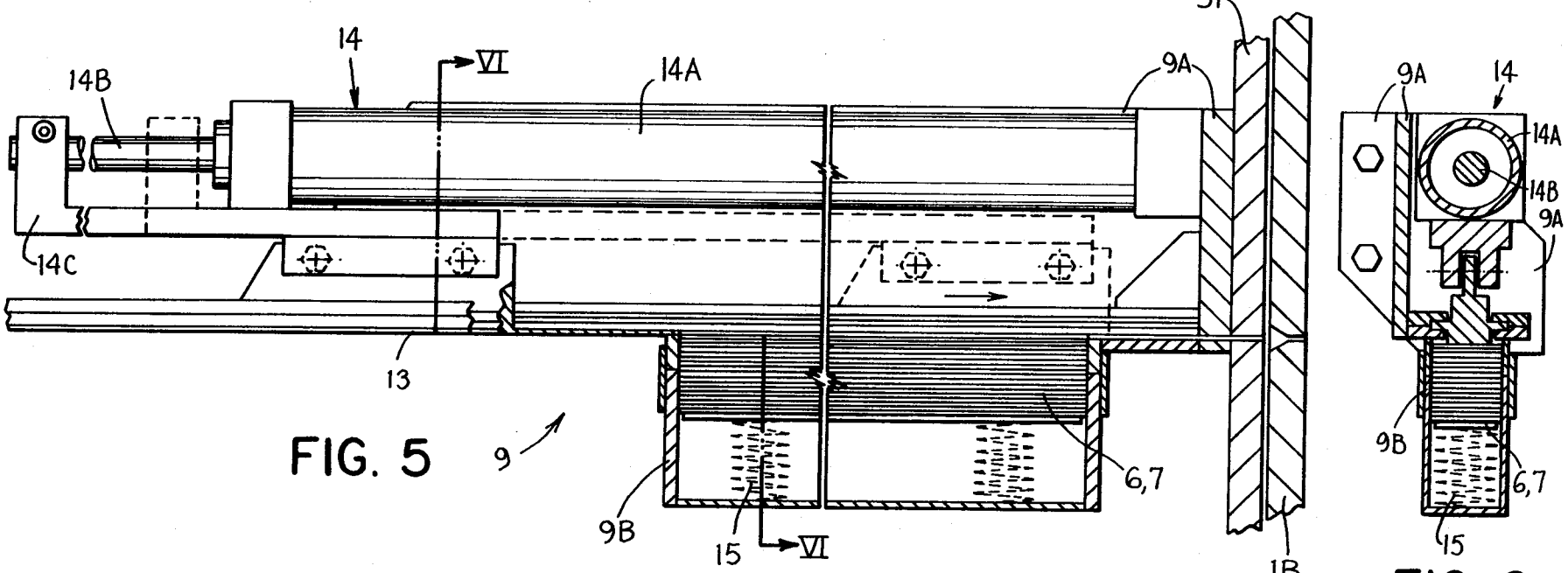
FIG. 5 is an enlarged fragmentary longitudinal cross-sectional view, of a magazine which is carried on one end of the beater mill.
FIG. 6 is a cross-sectional view substantially taken on the line VI—VI with the apparatus in its dotted line position of FIG. 5.

Stacks of replacement striking bars 6 and wear plates 7 are held stacked in the magazine 9A of a respective magazine unit 9 (of which one is shown in FIGS. 5 and 6). Each magazine unit 9 includes a slide member 13 reciprocated by a cylinder 14 periodically to successively axially feed the replacement striking bars 6 or wear plates 7, each with different feeding speeds, through the stationary crushing path 2. As soon as one striking bar 6 or wear plate 7 has been fed from the magazine to the crushing path 2, the slide member 13 returns to its initial (remote) position (shown in solid lines in FIG. 5), after which the pressure springs 15 move the next striking bar 6 or wear plate 7 into the feeding position ahead of the slide member. In the embodiment shown, the cylinder 14 is preferably a pressure fluid cylinder whose housing 14A is fixed with respect to a magazine 9B and a mounting bracket 9A and whose piston rod 14B extends leftwardly in FIG. 5 and through a coupling 14C connects to the slider member 13.

If desired, one such magazine unit 9 may be provided for each wear plate 7 and striking bar 6 location along the cylindrical crushing path 2 (i.e., three magazine units per crossbar 2A). However, this would require a substantial number of magazine units 9 which would then have to be more compactly designed than shown in FIGS. 5 and 6, in order to all fit on one end wall 1B of the housing 1A, even with relatively few (for example 7) crossbars 2A present in the mill 1. See for example the distribution of outlet slots 33 for striking bars 6 and wear plates 7 shown in FIG. 7 hereafter discussed.

Alternately, in the embodiment shown in FIGS. 1 and 2, a rotatably indexable mounting plate 31 is supported for rotation on the end of the shaft 5B close adjacent the input end wall 1B of housing 1A and carries at least three magazine units 9, namely a magazine unit 9X carrying striking bars 6, a magazine unit 9Y carrying wear plates 7 for the location 7L on each crossbar 2A and a magazine unit 9Z carrying wear plates 7 for the location 7R on each crossbar 2A (the locations 7L and 7R being shown in FIG. 2). By appropriate circumferential indexing of the mounting plate 31, either manually or by suitable motor means as schematically indicated at M2 in FIG. 2, the magazine units 9X, 9Y and 9Z are brought into registration with successive ones of corresponding inlet slots 32X, 32Y and 32Z in the input end wall 1B. In the embodiment shown, the slots 32X, 32Y and 32Z form a substantially Y-shaped composite slot with portions 32X, 32Z and 32Y respectively axially aligned with the striking bar 6 and wear plate 7R on one crossbar 2A and the wear plate 7L coacting with the striking bar 6 and located on the adjacent crossbar 2A. It will be apparent from FIG. 1 that at a given circumferential position of the mounting plate 31, the magazine units 9X, 9Y and 9Z axially oppose different crossbars 2A.

If desired, suitable detent means, not shown, may be interposed between the housing 1A and mounting plate 31 to ensure registry of the magazine units 9. If desired, the mounting plate 31 may carry additional magazine units not shown. For example, the left side of the mounting plate 31 (not shown in FIG. 1) may carry a second set of the three magazine units 9X, 9Y and 9Z, so that, for example, two striking bars 6, for example on opposite sides of the rotor 5A, could be replaced simultaneously. On the discharge side of the bear mill 1, any convenient means such as simple receiving magazines or hoppers 36 receive the worn striking bars 6 or wear plates 7. When a replacement wear plate 7 or striking bar 6 is inserted into position on its corresponding crossbar 2A, the corresponding worn wear plate 7 or striking bar 6 will be axially pushed by its replacement leftwardly in FIGS. 2 and 4 through a corresponding slot 33 in the housing end wall 1C. Slots 33X, 33Y and 33Z in the housing outlet end wall 1C correspond to and are axially aligned with the above-discussed slots 32X, 32Y and 32Z in the housing inlet end wall 1B. Although FIGS. 4, 5 and 6 show in cross section the details of one magazine unit and corresponding housing end wall slotting 32 and 33 for one kind of plate, for example the striking plates 6, the corresponding structure for the wear plates 7 will be understood to be identical and thus need not be shown in additional drawings.

Figure 8:
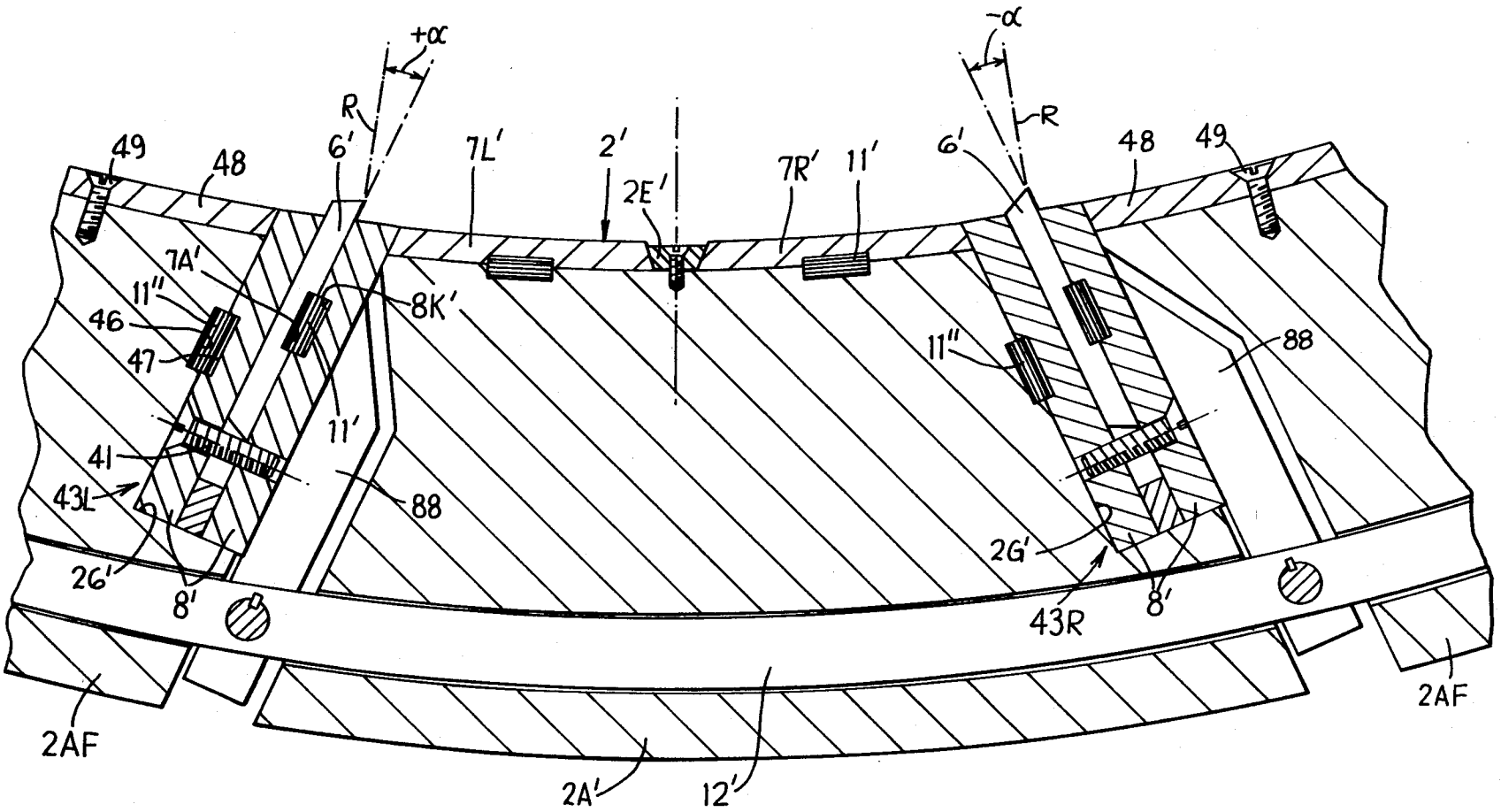
FIG. 8 is an enlarged fragmentary cross-sectional view similar to FIG. 3 but showing a modified crushing path segment, in which the striking bars are each movable together with a flanking pair of pressure plates through the stationary crushing path.

In the inventive modification according to FIG. 8, the striking bars 6' are each first clamped between two adjustably and regrindably arranged pressure plates 8' by tightening screws 41 and together with these flanking pressure plates 8' are then moved, as a unitary sandwich 43, axially through the stationary crushing path 2'. In this embodiment the necessity of providing permanent magnets 16' does not exist. This is achieved in the following manner. In FIG. 8 the sandwich 43L and the adjacent (rightward in FIG. 8) sandwich 43R differ in lying respectively at a positive and a negative angle $\alpha$ to a radius R from the rotational axis of the mill. Accordingly, the radially inner (upper in FIG. 8) ends of the pressure plates 8' of sandwich 43L are ground at a different angle than those of the sandwich 43R.

Also, whereas the countersink for the screw 41 may be in either the rightward or leftward pressure plate 8' in the sandwich (compare sandwiches 43L and 43R for example), the groove 8K for the spring 11', since it must match the groove 7A' in the striking bar 6', must be on the upstream (rightward in FIG. 8) pressure plate 8' in both sandwiches 43L and 43R.

In the particular embodiment shown in FIG. 8, the sandwich 43R is clamped in its recess 2G' in crossbar 2A' by a secondary pressure plate 88 carried on a tension ring 12' in the manner above discussed with respect to FIG. 3 elements 8 and 12. The leftward sandwich 43L is similarly held in its recess 2G' in a further crossbar 2AL by a similar secondary pressure plate 88 similarly operated by tension ring 12'. In the embodiment shown, the sandwiches 43L and 43R are prevented from dropping radially inwardly (up in FIG. 8) from their corresponding recesses 2G' as they are being axially advanced along the crushing path 2', by means of further springs 11'' disposed in grooves 46 and 47 opposed in the facing crossbar and pressure plate 8'. With the sandwiches 43L and 43R in place as shown in FIG. 8, same provide an undercut portion cooperating with the undercut edges of the guide rail 2E' circumferentially spaced therefrom, for holding the wear plates 7L' and 7R' securely against the interior face of the crossbar 2A', even when such wear plates 7L' and 7R' are being replaced by moving axially through the beater mill. Circumferentially flanking the above-discussed structure are fixed wear plates 48 secured, for example by means of screws 49, to crossbars 2AF flanking the crossbar 2A'. Unlike in the FIGS. 1-7 embodiment, the crossbars 2A' and 2AF are not identical, but rather differ in cross section depending on their location with respect to the sandwiches 43L and 43R. It will be further understood that the circumferential segment of the apparatus shown in FIG. 8 will normally be repeated several times along the circumference of the crushing path 2'.

Assuming the next circumferential repetition of the FIG. 8 structure (left and right sandwiches 43L and 43R and intervening wear plates 7L' and 7R') is spaced far enough away circumferentially, individual magazines, substantially of the kind discussed above with respect to FIG. 5, may be provided for each of the sandwiches 43L and 43R and wear plates 7L' and 7R' and may be fixedly mounted on the end wall of the housing. Indeed, some magazines may be mounted on one housing end wall and some on the other to avoid crowding. Care must be taken to avoid interference between the bracket structure of a magazine and an entry or exit slot for the adjacent one of the sandwiches or wear plates.

As one alternative, the magazines may be rotated on a rotating disc like that illustrated in FIG. 1, so that only one or two magazines need be provided for each of the replaceable members 43L, 7L', 7R' and 43R, with the disc being rotatably advanceable to new circumferential locations along the path 2', as in FIGS. 1 and 2.

As a second alternative, the sandwiches 43L and 43R each may be lengthened to several times the axial width of the housing 1A and may be gradually or periodically (a length portion at a time) advanced axially through the path 2' without the use of a magazine unit 9. Such advancement may be manual or by suitable mechanical means such as a lengthened magazine unit 9 without a magazine 9B.

Obviously the slots in the housing end wall (and in the rotating disc if provided) must be thicker for the sandwiches 43L and 43R than for the wear plates 7L' and 7R'.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. Apparatus for the manufacture of chips from mineral, vegetable or embrittled materials comprising a beater mill having a stationary crushing path extending in a longitudinal direction and a rotating beater rotor carrying beater shoe arms each provided with beater shoes, the stationary crushing path being equipped with replaceable wear plates and striking bars, at least one magazine aligned in the longitudinal direction of the stationary crushing path for supplying replacement wear plates to said stationary crushing path and at least one further magazine arranged in the longitudinal direction of the stationary crushing path for supplying replacement striking bars to said stationary crushing path.

2. Apparatus according to claim 1, wherein the wear plates and striking bars are completely identical to each other in their form and are provided with grooves.

3. Apparatus according to claim 1, wherein the replacement wear plates and striking bars are stacked on the input side in respective ones of said magazines, said magazines each having one slide member which is operated by a cylinder for feeding the wear plates or striking bars in that magazine.

* * * * *